US009751665B2

(12) United States Patent
Fleming

(10) Patent No.: US 9,751,665 B2
(45) Date of Patent: Sep. 5, 2017

(54) DRINK-THROUGH BEVERAGE CONTAINER LIDS WITH SPILL RESISTANT TABS

(71) Applicant: Douglas H. Fleming, Bainbridge Island, WA (US)

(72) Inventor: Douglas H. Fleming, Bainbridge Island, WA (US)

( * ) Notice: Subject to any disclaimer, the term of this patent is extended or adjusted under 35 U.S.C. 154(b) by 0 days.

(21) Appl. No.: 14/178,248

(22) Filed: Feb. 11, 2014

(65) Prior Publication Data

US 2015/0223625 A1 Aug. 13, 2015

(51) Int. Cl.

| | |
|---|---|
| ***A47G 19/22*** | (2006.01) |
| ***B65D 47/04*** | (2006.01) |
| ***B65D 47/20*** | (2006.01) |
| ***B65D 43/02*** | (2006.01) |

(52) U.S. Cl.

CPC ..... *B65D 47/2056* (2013.01); *B65D 43/0212* (2013.01); *B65D 2543/00046* (2013.01); *B65D 2543/00092* (2013.01); *B65D 2543/00296* (2013.01); *B65D 2543/00527* (2013.01); *B65D 2543/00537* (2013.01); *B65D 2543/00638* (2013.01); *B65D 2543/00685* (2013.01); *B65D 2543/00731* (2013.01); *B65D 2543/00796* (2013.01)

(58) Field of Classification Search

CPC ..... B65D 2543/00046; B65D 47/043; B65D 2543/0231; B65D 47/066; B65D 47/2018; A47G 19/2272; A47G 19/22

See application file for complete search history.

(56) References Cited

U.S. PATENT DOCUMENTS

| | | | |
|---|---|---|---|
| 2,358,600 | A | 9/1944 | Selten |
| 2,362,354 | A | 11/1944 | Clovis |
| 3,360,161 | A | 12/1967 | Smith |

(Continued)

FOREIGN PATENT DOCUMENTS

| | | |
|---|---|---|
| CA | 2245369 | 3/2000 |
| CA | 2212228 | 7/2002 |

(Continued)

OTHER PUBLICATIONS

US 6,003,721, 12/1999, Fleming (withdrawn)

(Continued)

*Primary Examiner* — Fenn C Mathew
*Assistant Examiner* — Andrew T Kirsch
(74) *Attorney, Agent, or Firm* — R. Reams Goodloe, Jr.

(57) ABSTRACT

A drink-through lid with spill resistant tab for use on a beverage container. The lid provides a drink outlet that allows liquid to fill a drink well base, from which a consumer may sip a beverage similar to using a cup. The lid is provided with a spill resistant tab. The tab may include a blade portion which fits through a slit in the drink-through lid. The blade extends outward to a distal blade edge adjacent an interior wall of the beverage container. The blade has a width $W_2$ as wide or wider than the effective outlet width $W_1$ of the drink outlet. The lid may be provided with a generally V-shaped groove having a slit at the bottom thereof for passage of the blade therethrough. In an embodiment, the tab may include a Z-shaped connector portion sized and shaped for interlocking mating engagement with the V-shaped grove.

26 Claims, 12 Drawing Sheets

(56) References Cited

U.S. PATENT DOCUMENTS

| | | | | |
|---|---|---|---|---|
| 3,400,855 | A | 9/1968 | Alexander | |
| 3,868,043 | A | 2/1975 | Freemyer | |
| 3,938,695 | A | 2/1976 | Ruff | |
| 3,977,559 | A | 8/1976 | Lombardi | |
| 3,994,411 | A | 11/1976 | Elfelt et al. | |
| 4,085,861 | A | 4/1978 | Ruff | |
| 4,090,660 | A | 5/1978 | Schram et al. | |
| 4,245,752 | A | 1/1981 | Prueher | |
| 4,361,249 | A * | 11/1982 | Tuneski | B65D 47/2018 215/317 |
| 4,502,608 | A | 3/1985 | Mills | |
| 4,582,214 | A | 4/1986 | Dart et al. | |
| 4,586,625 | A | 5/1986 | Garrett | |
| 4,589,569 | A | 5/1986 | Clements | |
| 4,609,124 | A | 9/1986 | Malloy | |
| 4,619,372 | A | 10/1986 | McFarland | |
| D287,919 | S | 1/1987 | Clements | |
| 4,768,674 | A | 9/1988 | Prescott | |
| D299,010 | S | 12/1988 | Wall | |
| 4,938,377 | A | 7/1990 | Jarvis | |
| 4,949,865 | A | 8/1990 | Turner | |
| 4,986,437 | A | 1/1991 | Farmer | |
| 5,111,961 | A | 5/1992 | Van Melle | |
| 5,183,172 | A | 2/1993 | Boller | |
| D342,097 | S | 12/1993 | Seaman | |
| D345,673 | S | 4/1994 | Dark | |
| 5,370,258 | A | 12/1994 | Fair | |
| 5,398,843 | A | 3/1995 | Warden et al. | |
| 5,540,350 | A | 7/1996 | Lansky | |
| 5,542,670 | A | 8/1996 | Morano | |
| D377,313 | S | 1/1997 | Tipp | |
| D377,810 | S | 2/1997 | Chaperon | |
| 5,699,927 | A | 12/1997 | Lane et al. | |
| 5,820,016 | A | 10/1998 | Stropkay | |
| 5,894,952 | A | 4/1999 | Mendenhall et al. | |
| 5,897,019 | A | 4/1999 | Stropkay | |
| D416,755 | S | 11/1999 | Trombly | |
| 5,988,426 | A | 11/1999 | Stern | |
| 6,003,711 | A | 12/1999 | Bilewitz | |
| 6,311,863 | B1 | 11/2001 | Fleming | |
| 6,325,236 | B1 * | 12/2001 | Wong | 220/713 |
| 6,375,033 | B1 | 4/2002 | Fleming | |
| D456,713 | S | 5/2002 | Bried et al. | |
| 6,419,105 | B1 | 7/2002 | Bruce et al. | |
| 6,571,973 | B1 | 6/2003 | Tripsianes | |
| D480,754 | S | 10/2003 | Berger | |
| 6,644,490 | B2 | 11/2003 | Clarke | |
| D485,758 | S | 1/2004 | Clarke et al. | |
| 6,886,707 | B2 | 5/2005 | Giraud | |
| 7,100,790 | B2 | 9/2006 | Dark | |
| D539,649 | S | 4/2007 | Smith et al. | |
| D539,650 | S | 4/2007 | Smith et al. | |
| D540,165 | S | 4/2007 | Hollis et al. | |
| D546,180 | S | 7/2007 | Jowett et al. | |
| D547,605 | S | 7/2007 | Edelstein et al. | |
| 7,246,716 | B2 | 7/2007 | Durdon | |
| 7,275,652 | B2 | 10/2007 | Morris et al. | |
| D566,552 | S | 4/2008 | Vette | |
| 7,353,582 | B2 | 4/2008 | MacKenzie et al. | |
| 7,484,638 | B2 | 2/2009 | Mazzarolo | |
| D592,056 | S | 5/2009 | Tedford, Jr. | |
| D592,952 | S | 5/2009 | Hundley et al. | |
| 7,556,172 | B2 * | 7/2009 | Lane | 220/714 |
| 7,591,393 | B2 | 9/2009 | Crudgington, Jr. | |
| D622,995 | S | 9/2010 | Beraha | |
| D627,827 | S | 11/2010 | Rogers | |
| D632,174 | S | 2/2011 | Charbonnet et al. | |
| D634,192 | S | 3/2011 | Mueller | |
| D635,855 | S | 4/2011 | Smith | |
| D637,079 | S | 5/2011 | Brown et al. | |
| 7,959,029 | B2 | 6/2011 | Whitaker et al. | |
| D641,242 | S | 7/2011 | Pfarrhofer | |
| D643,245 | S | 8/2011 | Minarsch | |
| D652,300 | S | 1/2012 | Anderson et al. | |
| D655,161 | S | 3/2012 | Daniel | |
| D655,162 | S | 3/2012 | Daniel | |
| D656,023 | S | 3/2012 | Baker et al. | |
| D660,718 | S | 5/2012 | McDermott et al. | |
| D679,753 | S | 4/2013 | Sato et al. | |
| D681,453 | S | 5/2013 | Glass et al. | |
| D690,988 | S | 10/2013 | Audette | |
| D691,847 | S | 10/2013 | Beckman | |
| D692,756 | S | 11/2013 | McClellan et al. | |
| 8,616,405 | B2 | 12/2013 | French et al. | |
| D709,367 | S | 7/2014 | Fleming | |
| D713,685 | S | 9/2014 | Eyal | |
| D721,271 | S | 1/2015 | Fabiszewski | |
| D721,540 | S | 1/2015 | Grcic | |
| 8,950,623 | B2 | 2/2015 | Fleming | |
| 9,061,796 | B2 | 6/2015 | Caldwell | |
| 2002/0038803 | A1 | 4/2002 | Malcolm | |
| 2002/0096530 | A1 | 7/2002 | Waller | |
| 2003/0218017 | A1 | 11/2003 | Schmidtner et al. | |
| 2005/0087539 | A1 | 4/2005 | Waller | |
| 2007/0114236 | A1 | 5/2007 | Shiffer et al. | |
| 2007/0199945 | A1 | 8/2007 | Ho | |
| 2008/0011762 | A1 | 1/2008 | Boone | |
| 2008/0061069 | A1 | 3/2008 | Edelstein et al. | |
| 2008/0245792 | A1 | 10/2008 | Chou | |
| 2009/0266828 | A1 | 10/2009 | Cai | |
| 2009/0266829 | A1 | 10/2009 | Bailey | |
| 2009/0294459 | A1 | 12/2009 | Hovsepian et al. | |
| 2009/0294460 | A1 | 12/2009 | Hovsepian et al. | |
| 2011/0114655 | A1 | 5/2011 | Bailey | |
| 2011/0266294 | A1 | 11/2011 | Charbonnet et al. | |
| 2012/0024871 | A1 | 2/2012 | Hundley et al. | |

FOREIGN PATENT DOCUMENTS

| | | | |
|---|---|---|---|
| CA | 2635219 | | 7/2008 |
| EP | 1118549 | B1 | 5/2006 |
| EP | 1043243 | B1 | 9/2006 |
| EP | 2121465 | B1 | 12/2013 |
| GB | 2307633 | A | 6/1997 |
| GB | 2322289 | A | 6/1998 |
| JP | 09-156661 | A | 6/1997 |
| WO | WO 96/39068 | | 12/1996 |
| WO | WO 2009/008587 | A1 | 1/2009 |
| WO | WO 2009/036426 | A2 | 3/2009 |
| WO | WO 2010/042027 | A1 | 4/2010 |

OTHER PUBLICATIONS

Louise Harpman & Scott Specht, Cabinet Magazine, Inventory/Peel, Pucker, Pinch, Puncture. Issue 19, Chance Fall 2005 (2005-09-00). http://www.cabinetmagazine.org/issues/19/harpman.php (4 pages).

Nicola, Edible Geography, The Evolution of Lids. (May 9, 2011), http://www.ediblegeography.com/the-evolution-of-lids/ (7 pages).

Date unknown. Printed Nov. 15, 2013. Product Design (physical goods): Why is the Solo Traveler the dominant coffee cup lid? http://www.quora.com/Product-Design-physical-goods/Why-is-the-Solo-Traveler-the-dominant-coffee-cup-lid (7 pages).

Supplemental European Search Report & Opinion Dated Sep. 30, 2015 European Patent Application No. EP13763858 (dated Oct. 9, 2015) (6 pgs).

PCT International Search Report—PCT/US2015/015069 (May 15, 2015) ISA:—Korean Intellectual Property Office (3 pages).

PCT Written Opinion of the International Searching Authority—PCT/US2015/015069 (May 15, 2015) ISA:—Korean Intellectual Property Office (10 pages).

Notification Concerning Transmittal of International Preliminary Report on Patentability—Dated: Aug. 25, 2016 with International Preliminary Report on Patentability ; Written Opinion of the International Searching Authority—Dated: Aug. 25, 2016 (12 pages).

* cited by examiner

DRINK-THROUGH BEVERAGE CONTAINER LIDS WITH SPILL RESISTANT TABS

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

RELATED PATENT APPLICATIONS

NONE.

TECHNICAL FIELD

This disclosure relates to lids for drinking cups, and more specifically, to drink-through lids for beverage containers, and elements thereof or items used therewith to minimize or substantially avoid escape of liquids therefrom.

BACKGROUND

Disposable beverage containers—which may also be described herein as drinking cups or beverage cups—are ubiquitous for use in "on-the-go" consumption of liquids, particularly hot beverages such as coffee or tea. Disposable beverage cups often utilize a disposable lid. Various lid designs include openings therein, or openable portions therein, configured with the idea of minimizing splashing or spilling of the beverage from the container.

One type of disposable lid that is now widely used is a drink-through type lid that provides a horizontally oriented drink outlet on a top surface of a raised rim. Such a design allows a user to drink through the lid in a manner similar in many respects to drinking through a straw, in that it usually seems that a limited amount of liquid is provided through the small opening. Unfortunately, and especially during transport, lids with such openings may allow escape of liquid (especially when full), unless the drink outlet is sealed, such as by use of a stopper or plug. Consequently, spill prevention devices used with such designs do not allow drinking without subsequent removal of the stopper or plug. Similarly, other disposable lids have been provided that include flip-open or rip-open tabs that lift to allow drinking, but which prevent drinking when such tabs are in an unopened or in a resealed condition.

Thus, there remains a need to provide a lid design for a disposable beverage cup or container that simultaneously minimizes or avoids spill of liquid from the beverage cup or container, while allowing the user to drink from the cup or container without first manipulating a flip-open or rip-open tab. It would be even more advantageous for such a lid design to be provided in a low cost, disposable material. It would be additionally desirable if such a lid design were available in a configuration that is easy to ship, compact for storage, and easy to install at point of sale. Further, it would be desirable if such a lid enhanced ease of use, by substantially preventing liquid spill during transport, while allowing drinking without the necessity of manipulating a flip-open, rip-open, slide-open, or removable component.

SUMMARY

Novel spill resistant tabs have been developed for use with drink-through type beverage container lids. Concurrently, drink-through lid designs have been developed which may receive and secure therein such spill resistant tabs. In various embodiments, such spill resistant tabs significantly enhance a user's beverage drinking experience as compared to various prior art drink-through lids for beverage containers. Various embodiments of novel spill resistant tabs allow prevention, or at least minimization of liquid spills from a cup or beverage container, while allowing a user to drink from the cup or beverage container without the necessity of first manipulating a closure mechanism, such as prior art flip-up or rip-open tabs, or removable closure features such as plugs or stoppers.

In an embodiment, the combination of a drink-through lid and a spill resistant tab are provided. In an embodiment, the drink-through lid may include a slit sized and shaped for passage therethrough of a blade portion of a spill resistant tab. In an embodiment, the drink through lid may include a land that is sized and shaped for receiving a handle portion of a spill resistant tab. In an embodiment, the handle portion may further include an ear portion, which may be slightly upturned for ease of manipulation of the spill resistant tab by a user.

In the drink-through lid, at least one drink outlet is provided. The at least one drink outlet may be defined by a first edgewall extending upward into the interior portion of the hollow raised lip portion, and by an elongated second edgewall extending along an outlet portion of the drink well base in proximity to the peripheral edge. In an embodiment, a portion of the at least one drink outlet may be oriented along a first surface extending from the elongated second edgewall at an angle alpha ($\alpha$) in the range of from about forty five degrees (45°) to about ninety degrees (90°). In an embodiment, the first surface may be a planar surface. In an embodiment, a portion of the at least one drink outlet may be oriented along a second surface extending along the drink well base. In an embodiment, the second surface may be a planar surface. In an embodiment, the drink outlet may be defined as if the first surface and the second surface are joined along a radiused curve. In an embodiment, a first planar surface and a second planar surface may be joined as if along a radiused curve. In an embodiment, an inwardly protruding shoulder may be provided from the interior portion of the hollow raised lip portion, and the drink outlet may be defined by an opening cut along the inwardly protruding shoulder. In an embodiment, the inwardly protruding shoulder may be arcuate in shape, with an upwardly directed arching central portion.

In further detail, a drink well base for containing liquid is provided in a drink-through lid. In an embodiment, the drink well base has a sloped floor extending upwardly from a peripheral side along the lower end portions. In an embodiment, the drink well base may be located above the bottom edge of the rim and below the outer lip portion. In an embodiment, the lowest portion of the floor of the drink well base may be located at or near the vertical level of the center line of the interior bead sealing portion. In an embodiment, the lowest portion of the floor of the drink well base may be located below the center line of the interior bead sealing portion. In various embodiments, the drink well base may be located vertically at a level that is below the center line of the interior bead sealing portion, or higher. The drink well base includes an underside surface, oriented toward the interior of a beverage container, when in use.

In an embodiment, a drink-through lid may be provided including a downwardly extending wall extending transversely across the drink-through lid. In an embodiment, the drink-through lid may include downwardly extending walls including a valley portion. In an embodiment, the valley portion may be located along a portion of a chord line of the drink-through lid, or along a diameter line of the drink-through lid. The valley portion may include V-shaped walls. A slit may be provided along a length of the valley portion. In an embodiment, the downwardly extending V-shaped walls may be parallel to the elongated second edgewall of the drink-through drink outlet. In an embodiment, the downwardly extending wall may be provided in a continuous shaped surface from edge to edge of the drink-through lid. In an embodiment, the V-shaped wall may be provided as a partial segment, or as a partial diameter, that does not extend to either edge of the drink-through lid.

In an embodiment, when a V-shaped groove is provided, across at least a portion of a drink-through lid, a slit may be provided at the bottom of the V-shaped groove. In an embodiment, a slit of length LS, defined by first and second ends, may be provided across at least a portion of the drink-through lid. In an embodiment, the slit may be perforated. In an embodiment, the slit may be further defined by a first edge and by a second edge in downwardly extending walls. Such downwardly extending walls may include at least portions of the noted V-shaped wall. In an embodiment, a slit may be utilized for locating a spill resistant tab therein. However, a drink-through lid including a slit may also be used on a beverage cup without a spill resistant tab inserted therein.

In an embodiment, the spill resistant tab may include a blade portion sized and shaped for passage through the slit when the spill resistant tab is being placed into a working position. In an embodiment, a spill resistant tab may also be provided with dimensions that provide locking features vis-a-vis a drink-through lid, to securely locate a spill resistant tab with respect to the lid. In an embodiment, the spill resistant tab may be locked into a position which provides close fitting engagement between an upper surface of the blade portion and the underside of the drink well.

The spill resistant tab may include a connector portion to link the handle portion and the blade portion. In an embodiment, the connector portion may be sized and shaped for placement into a secure mating engagement position with a portion of the drink-through lid, such as the valley. In an embodiment, the connector portion, when in a working position, may be placed into secure mating engagement with a portion of the V-shaped walls. In an embodiment, the connector portion may be provided in a generally planar configuration. When the connector portion is provided in a generally planar configuration, and at least proximal end of the blade portion is provided in a generally planar configuration, and at least the proximal end of the handle is provided in a generally planar configuration, then a fold may be provided such that there is a first hinge point between the proximal end of the handle and the connector portion, and a second hinge point between the connector portion and the proximal end of the blade portion. In a secure mating engagement position, the spill resistant tab may be secured in a working position, wherein the blade portion is located near or adjacent the underside of a drink well. In such a location, the blade provides a barrier between the drink outlet and the interior of a beverage container. Further, in an embodiment, the blade portion of spill resistant tab may include a blade edge that is edge sized and shaped for close fitting engagement near, or against, an arcuate portion of the inner sidewall of a beverage container in which the spill resistant tab is placed. In an embodiment, the blade edge may be radiused to provide a relatively constant gap G distance between the blade edge and the interior sidewall of a beverage cup. In such manner, upward flow of liquid from the interior of a beverage container is substantially prevented, as liquid must flow circumferentially above the blade, and then upward through a drink outlet and into the drink well, before escaping. Thus, direct splash of liquid from the interior of a beverage container, outward through the drink outlet, is effectively prevented.

BRIEF DESCRIPTION OF THE DRAWING

The present invention(s) will be described by way of exemplary embodiments, using for illustration the accompanying drawing in which like reference numerals denote like elements, and in which.

Figure 1:
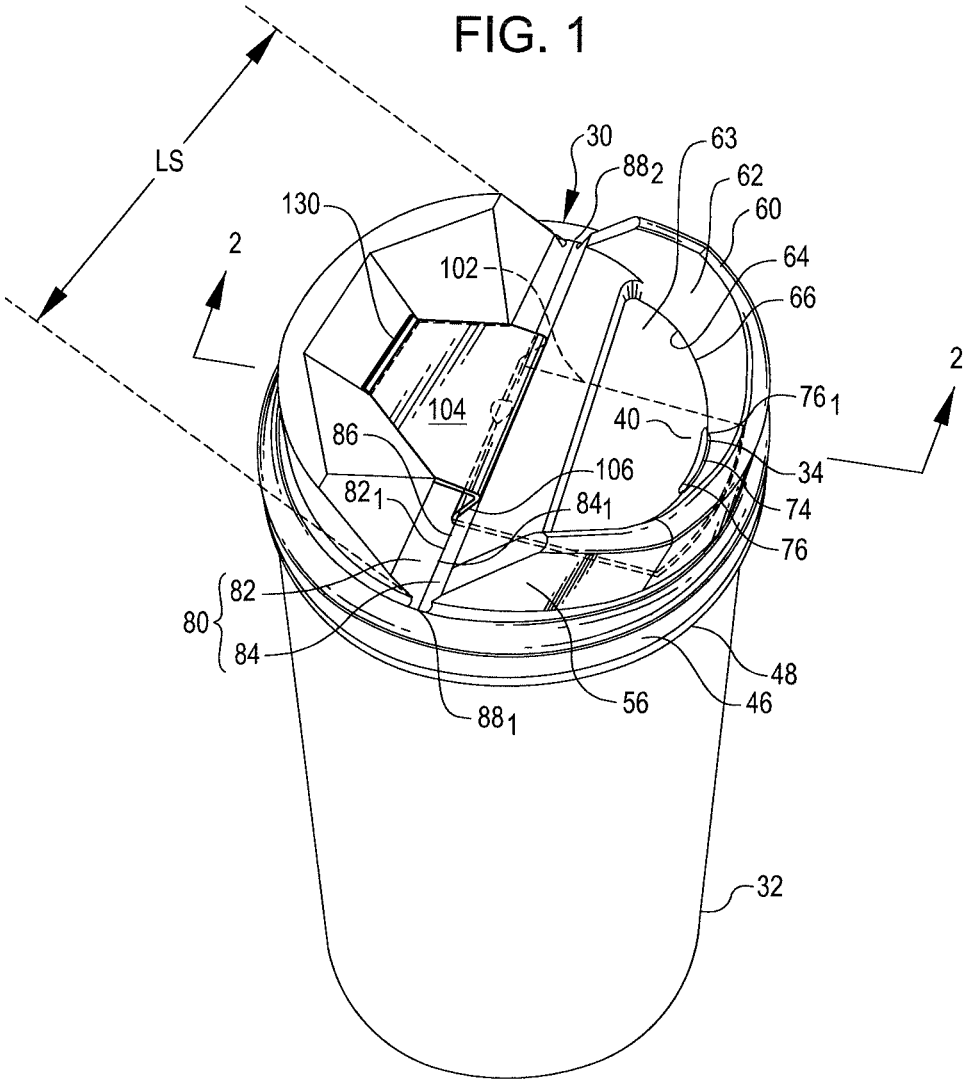
FIG. 1 is a perspective view of an embodiment for a drink-through lid for a cup, having a drink well base into which liquid emerges for consumption, and which also shows a tab which extends in part through the lid, and with respect to which the portion which is below the lid is shown in hidden lines.

The foregoing figures, being merely exemplary, contain various elements that may be present or omitted from a final configuration for a drink-through disposable lid suitable for use with a spill resistant tab utilizing the principles taught herein, or that may be implemented in various embodiments described herein for such lids and tabs. Other variations in drink-through lid designs and spill resistant tab designs may use slightly different mechanical structures, angular configurations, mechanical fit arrangements, liquid flow configurations, or vapor flow configurations, and yet employ the principles described herein and as generally depicted in the drawing figures provided. An attempt has been made to draw the figures in a way that illustrates at least those elements that are significant for an understanding of exemplary drink-through lid and spill resistant tab designs for use on beverage containers. Such details may be quite useful for providing a high quality improved beverage container drink-through lids with spill resistant tabs, for use in both minimizing spills while avoiding the necessity to manipulate closure mechanisms.

It should be understood that various features may be utilized in accord with the teachings hereof, as may be useful in different embodiments as useful for various sizes and shapes of cups, drink-through lids, and spill resistant tabs, within the scope and coverage of the teachings herein as defined by the claims. Further, like features in various lid and spill resistant tab designs, may be described using like reference numerals, or other like references, without further mention thereof.

DETAILED DESCRIPTION

Figure 2:
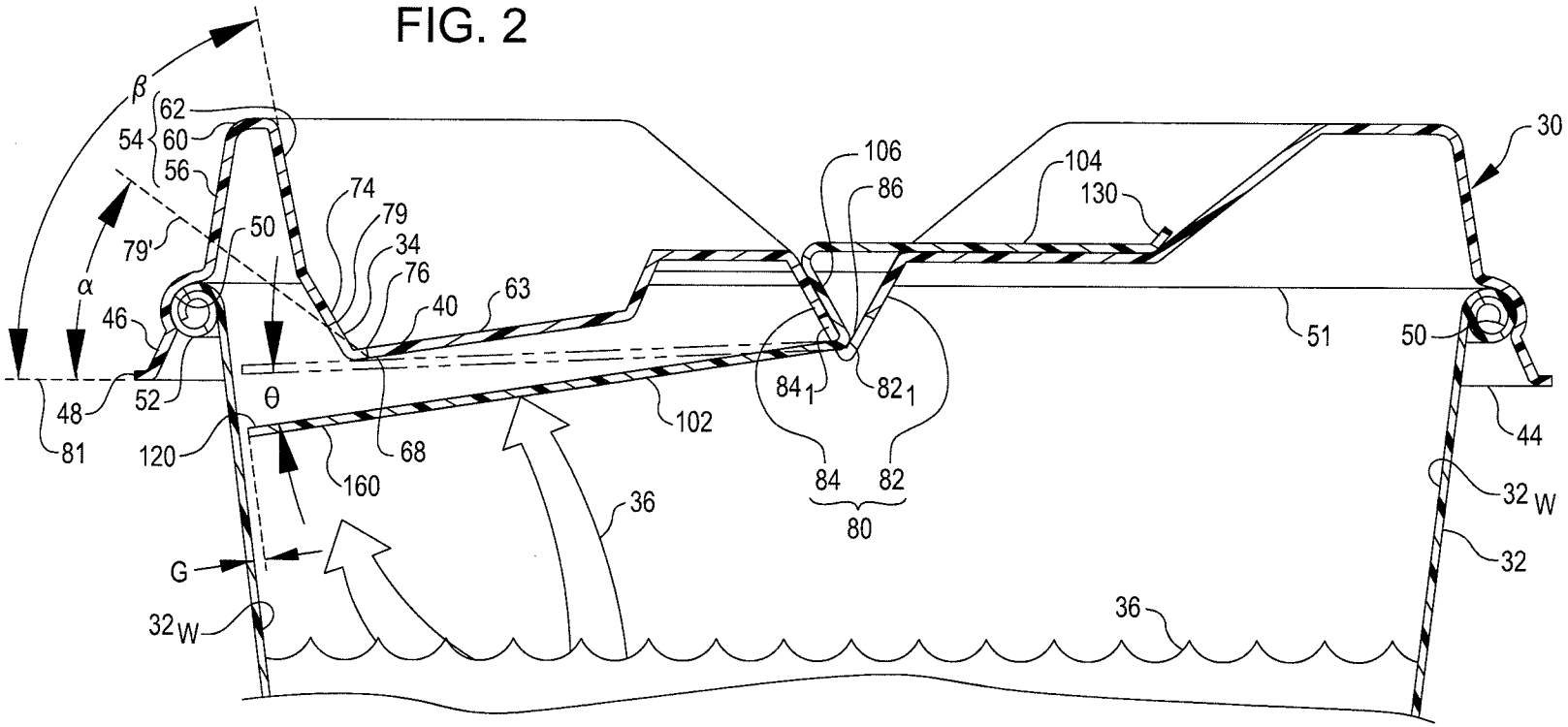
FIG. 2 is a vertical cross-sectional view taken through line 2-2 of FIG. 1, and in which the drink-through lid is shown with an embodiment for a spill resistant tab that extends through the lid and thence outwardly toward the inner sidewall of a cup on which the lid is placed, and showing between solid lines and hidden lines movement which may be allowed in a flexible spill resistant tab.
Figure 3:
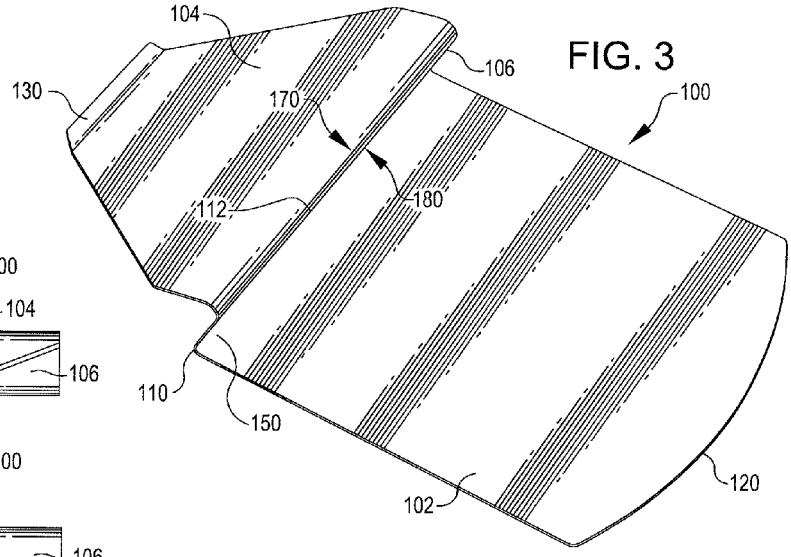
FIG. 3 is a perspective view of a spill resistant tab for use in a lid for a beverage container; the tab was first shown in FIGS. 1 and 2 above, and may be used in combination with a drink-through lid to provide spill resistance, yet allow a user to drink liquid from the cup without the necessity to remove the tab from the drink-through lid.
Figure 4:
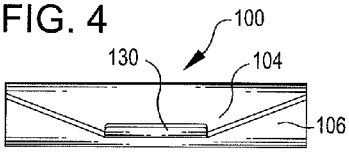
FIG. 4 is a front side view of a first embodiment for a spill resistant tab.
Figure 5:
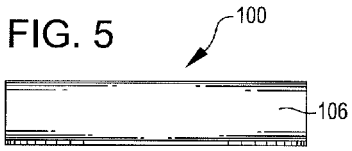
FIG. 5 is a back side view of a first embodiment for a spill resistant tab.
Figure 6:
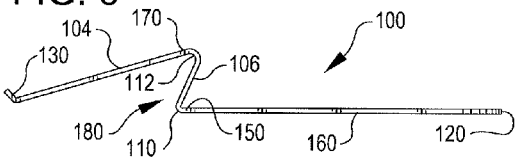
FIG. 6 is a left side view of a first embodiment for a spill resistant tab.
Figure 7:
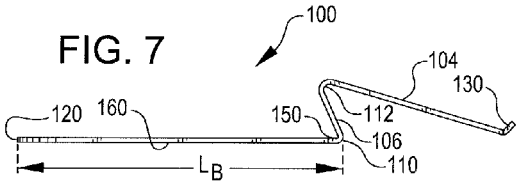
FIG. 7 is a right side view of a first embodiment for a spill resistant tab.
Figure 8:
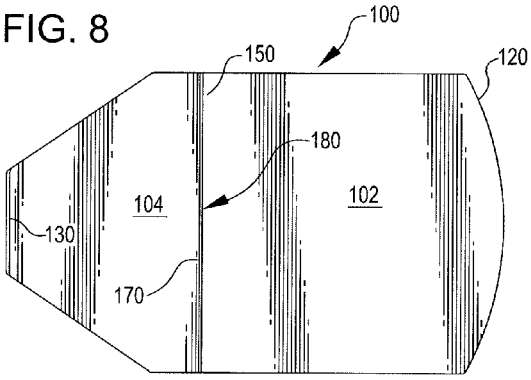
FIG. 8 is a top plan view of a first embodiment for a spill resistant tab.
Figure 9:
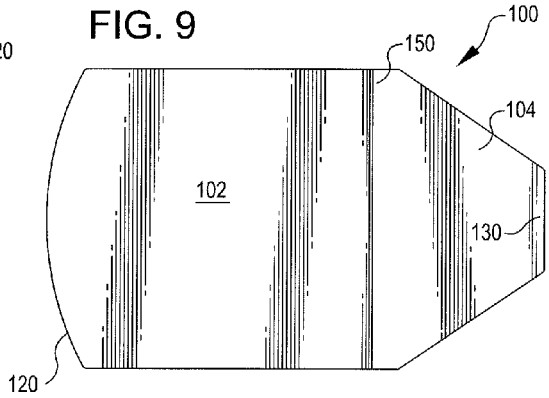
FIG. 9 is a bottom plan view of a first embodiment for a spill resistant tab.

Attention is directed to FIGS. 1 and 2, where a first embodiment for a drink-through lid 30 for a beverage container 32 is provided. A lid 30 provides at least one drink outlet 34, that allows liquid 36 (see such action depicted by arrow 38 in a second embodiment 39 of a drink-through lid in FIG. 21) to fill a drink well base 40, from which a user or consumer may sip a beverage in a manner similar to when using a cup or mug. Extensive details of exemplary embodiments of such drink-through lids which may be useful for adaption for with a spill resistant tabs described herein have previously been described (a) in U.S. patent application Ser. No. 13/797,858, filed Mar. 12, 2013, entitled Lid and Vapor Directing Baffle for Beverage Container, (b) in U.S. patent application Ser. No. 29/476,072, filed Dec. 10, 2013, entitled Lid for Beverage Container, and (c) in U.S. patent application Ser. No. 29/433,175, filed Sep. 26, 2012, entitled Lid for Beverage Container, the disclosures of each of which are incorporated herein by reference in their entirety, including the specification, the claims, and the drawing figures of each patent application.

The lid 30 has a base 44 with rim 46 having a bottom edge 48, and an interior bead sealing portion 50. In an embodiment, rim 46 may be annular in shape. The base 44 is sized and shaped to sealingly engage an open end 51 (generally circular) of beverage container 32, which may be defined by a bead 52 of a beverage container 32. A hollow raised lip portion 54 is provided, and it has an exterior portion 56 extending upwardly from the drink well base 40, an outer lip portion 60, and an interior portion 62 sloping downwardly and inwardly from the outer lip portion 60 to lower end portions 66.

Figure 10:
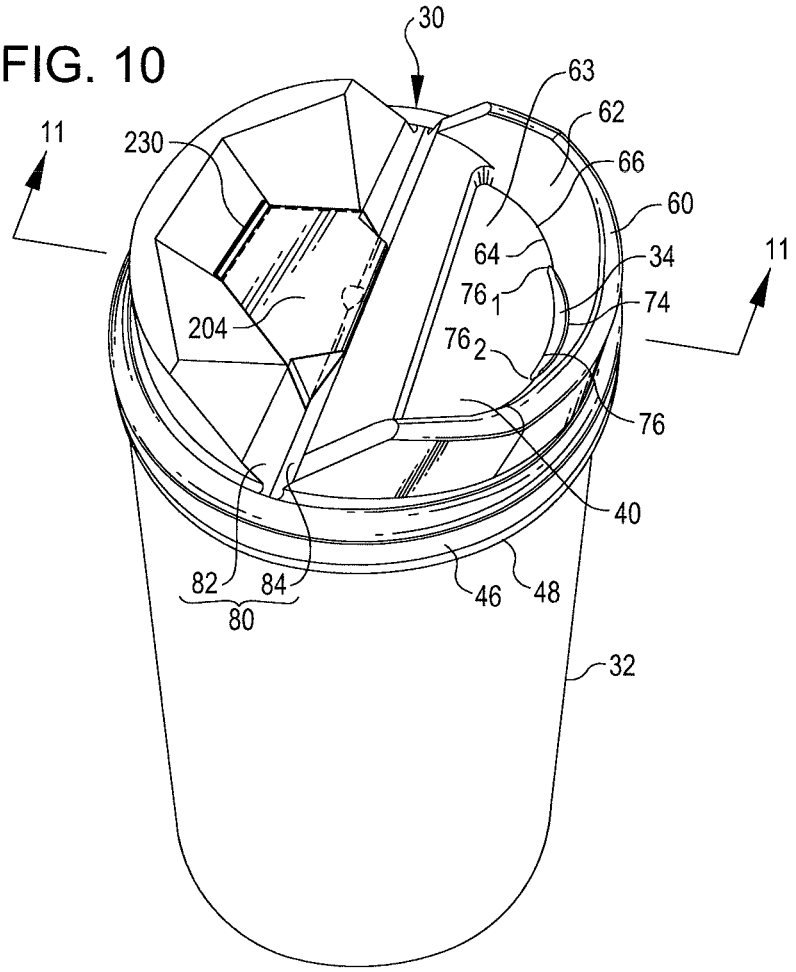
FIG. 10 is similar to FIG. 1, but now illustrates use of a second embodiment for a novel spill resistant tab which may be utilized to provide spill resistance, yet allow a user to drink liquid from the cup via the drink-through lid without the necessity to remove the tab from the drink-through lid.

A drink well base 40 for containing liquid 36 (see FIG. 21) is provided. The drink well base 40 has a floor 63 extending from a peripheral side 64 (see FIG. 1, 10, or 19) along at least some of the lower end portions 66. In an embodiment, the floor 63 may extend upwardly and inwardly from the peripheral side 64. In an embodiment (see FIG. 1, 10, or 19) an underside 68 (see FIG. 2, 11, or 20) of drink well base 40 may be located above the bottom edge 48 of the annular flanged rim 46 and substantially below the outer lip portion 60. At least one drink outlet 34 is provided. The at least one drink outlet 34 may be defined by a first edgewall 74 extending upward into the interior portion 62 of the hollow raised lip portion 54 and by an elongated second edgewall 76 extending along the drink well base 40 in proximity to the peripheral side 64. In an embodiment, the first edgewall 74 may be arcuate in shape. The least one drink outlet 34 is oriented along a surface 80, which in an embodiment may be a generally planar surface, (see FIG. 2) extending from the elongated second edgewall 76 at an angle alpha ($\alpha$) in the range of from about forty five degrees (45°) to about ninety degrees (90°), compared to a plane 81 defined by the bottom edge 48 of the annular flanged rim 46. In various embodiments, the angle alpha ($\alpha$) may be in the range of from about fifty degrees (50°) to about seventy degrees (70°). In yet further embodiments, the angle alpha ($\alpha$) may be at about sixty degrees (60°). Thus, in various embodiments as just described, a drink outlet 34 may be provided in configuration which is more vertically oriented than horizontally oriented.

Figure 11:
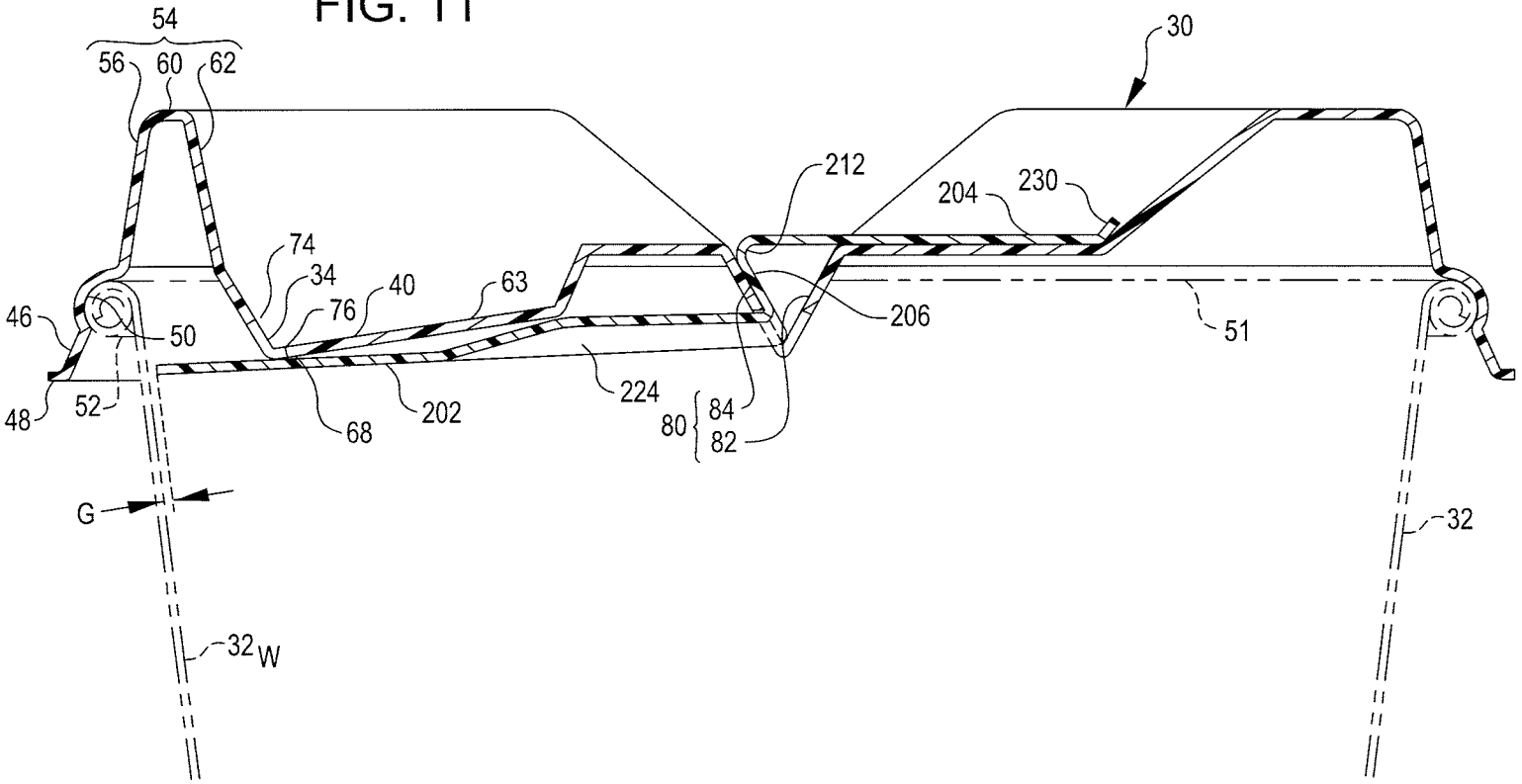
FIG. 11 is a vertical cross-sectional view taken through line 11-11 of FIG. 10, and in which the drink-through lid is shown with a second embodiment for a spill resistant tab that extends through the lid and thence outwardly toward the inner sidewall of a cup on which the lid is placed, and showing a configuration wherein the spill resistant tab is located adjacent a drink outlet in the drink-through lid.
Figure 12:
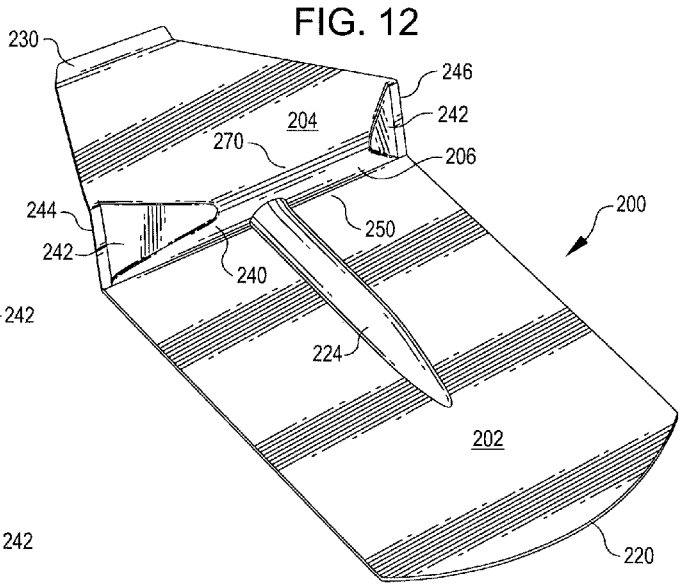
FIG. 12 is a perspective view of a second embodiment for a spill resistant tab for use in a lid for a beverage container; this embodiment for a tab was first shown in FIGS. 10 and 11 above, and may be used in combination with a drink-through lid to provide spill resistance, yet allow a user to drink liquid from the cup without the necessity to remove the tab from the drink-through lid.
Figure 13:
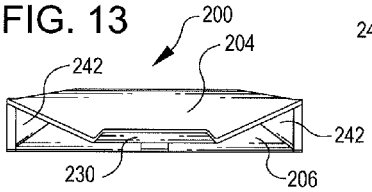
FIG. 13 is a front side view of a second embodiment for a spill resistant tab.
Figure 14:
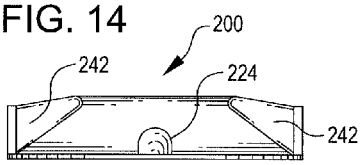
FIG. 14 is a back side view of a second embodiment for a spill resistant tab.
Figure 15:
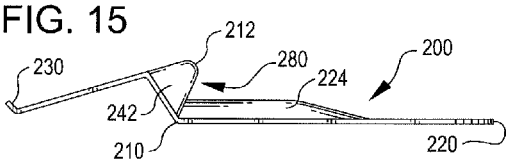
FIG. 15 is a left side view of a second embodiment for a spill resistant tab.
Figure 16:
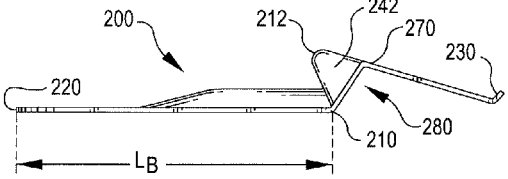
FIG. 16 is a right side view of a second embodiment for a spill resistant tab.
Figure 17:
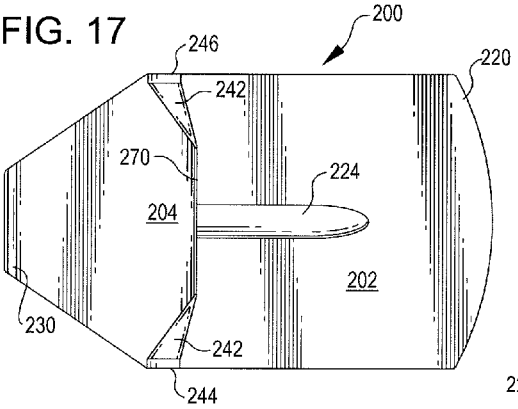
FIG. 17 is a top plan view of a second embodiment for a spill resistant tab.
Figure 18:
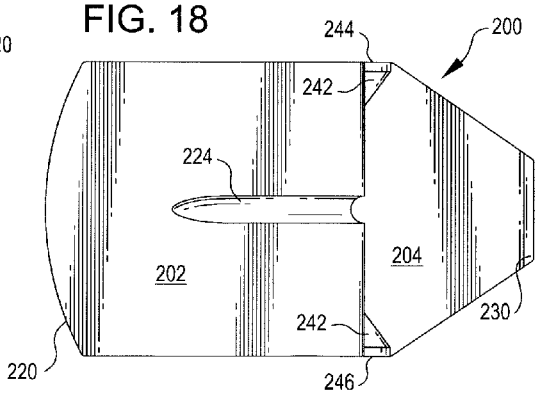
FIG. 18 is a bottom plan view of a second embodiment for a spill resistant tab.
Figure 20:
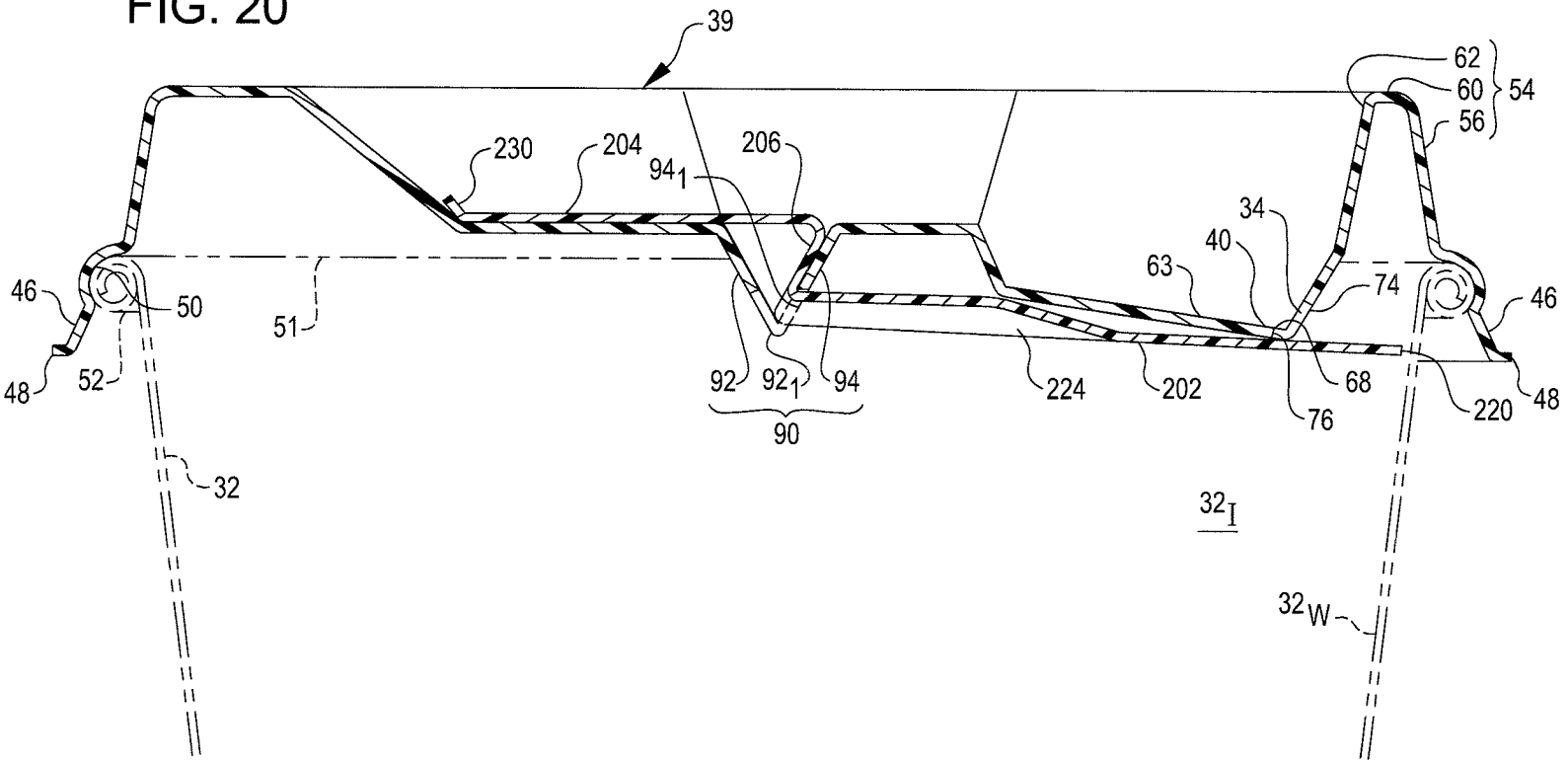
FIG. 20 is a vertical cross-sectional view taken through line 20-20 of FIG. 19, and in which a second embodiment for a drink-through lid is shown with a second embodiment for a spill resistant tab, showing the spill resistant tab securely fitting in a generally V-shaped groove in the drink-through lid, and thence outwardly toward the inner sidewall of a cup on which the lid is placed, and showing a configuration wherein the spill resistant tab is located adjacent a drink outlet in the drink-through lid.

As seen in FIGS. 2, 11, and 20, various embodiments may be provided wherein the interior portion 62 of the hollow raised lip portion 54 slopes downwardly and inwardly at an angle beta ($\beta$) in the range of from about seventy degrees (70°) to almost about ninety degrees (90°), provided that the angle beta ($\beta$) selected allows for removal of a lid 30 or the like from a mold in a manufacturing process. In various embodiments, an angle beta ($\beta$) may be provided in the range of from about seventy degrees (70°) to about eighty five degrees (85°).

Figure 19:
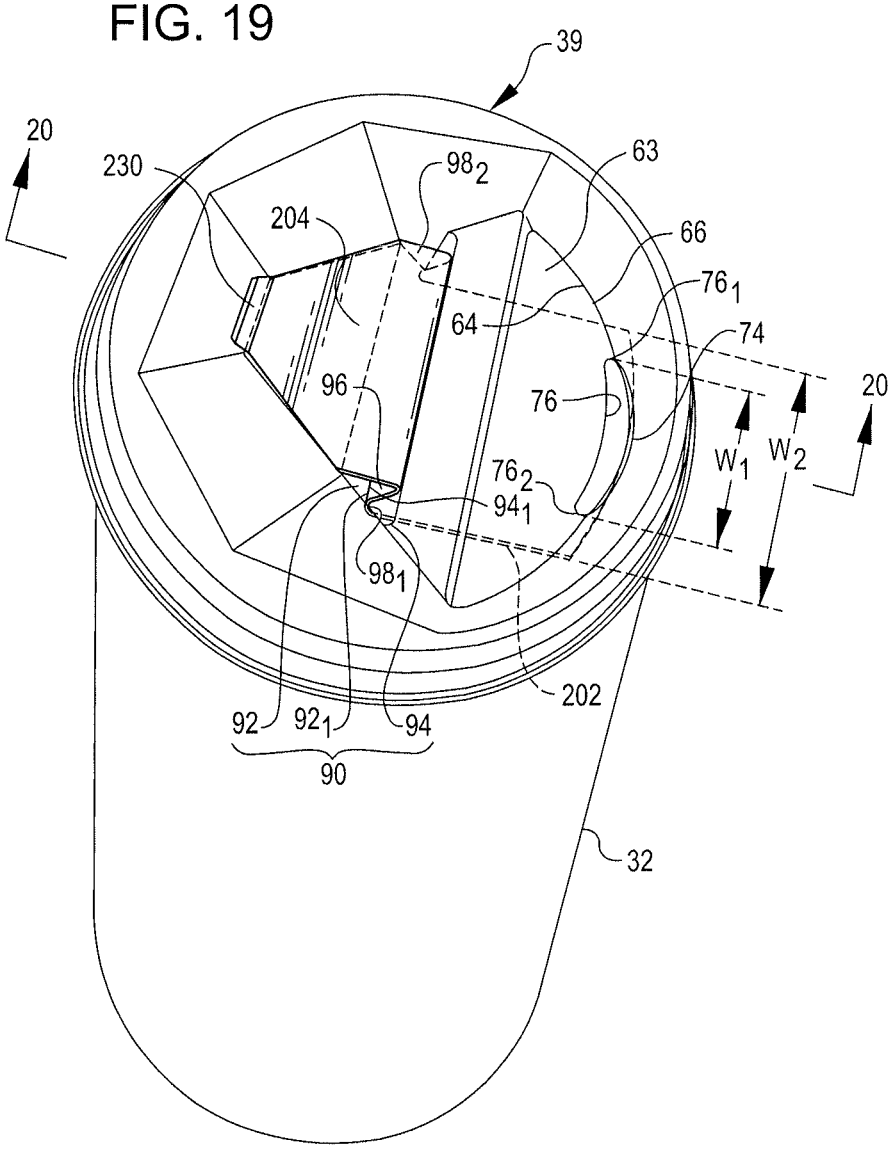
FIG. 19 is similar to FIGS. 1 and 10, but now illustrates another embodiment for a novel drink-through lid in which a spill resistant tab, such the embodiments shown in FIG. 3 or in FIG. 12 may be utilized to provide spill resistance, yet allow a user to drink liquid from the cup without the necessity to remove the tab from the drink-through lid.

Turning now to FIG. 19, it can be seen that in an embodiment, the elongated second edgewall 76 of the drink outlet 34 may have an effective opening width $W_1$. In the embodiment shown in FIG. 2, the elongated second edgewall 76 is parallel to the line 94 tangent to an outer edge 92 of the annular flanged rim 46. In various embodiments, the effective opening width $W_1$ may be provided in a length less than or equal to about two (2) inches (5.08 cm). In various embodiments, the effective opening width $W_1$ may be provided in an overall length of about one (1) inch (2.54 cm), plus or minus about fifty percent (50%). In various embodiments, the effective opening width $W_1$ may be provided in an overall length of about one (1) inch (2.54 cm), plus or minus about twenty five percent (25%). As used in this disclosure, the effective opening width $W_1$ is the lateral distance from first end $76_1$ to second end $76_2$ of second edgewall 76 of drink outlet 34, regardless of whether the second edgewall 76 is generally straight, or curved, such as having the generally outwardly bowed shape seen in FIG. 19.

Figure 21:
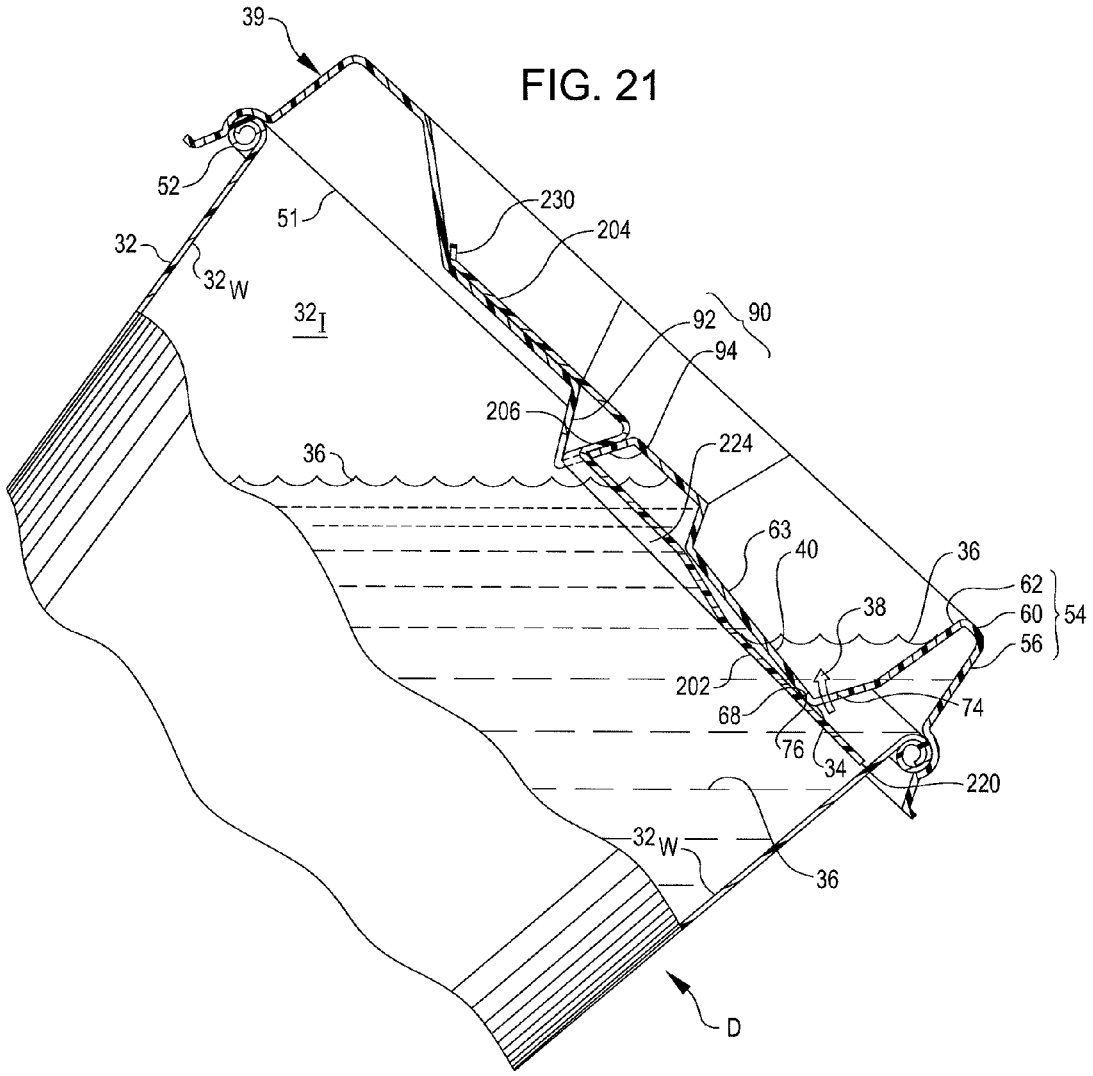
FIG. 21 is a partial sectional side view of a beverage container with a drink-through lid thereon, showing the beverage container as if being tilted by a user for drinking, so that liquid passage is seen through the drink outlet, and showing how the location of the spill resistant tab prevents liquid from rushing outward through the drink outlet, since any liquid surge toward the drink outlet would be deflected laterally, away from the drink outlet.

As seen in FIG. 2, the drink outlet 34 is spaced apart from, but adjacent to, the interior bead sealing portion 50 of drink-through lid 30 (or lid 39 as shown in FIGS. 20 and 21). The drink outlet 34 allows liquid 36 into the drink well base 40, along floor 63, when a beverage container 32 utilizing a drink-through lid 30 or 39 or the like is turned from a vertical position toward a drinking position D as illustrated in FIG. 21.

Turning now to FIGS. 1, 2, 10 and 11, an embodiment for a drink-through lid 30 is provided where a downwardly extending valley 80 is provided, via valley sidewalls 82 and 84. In an embodiment sidewalls 82 and 84 may cooperate to provide a generally V-shaped (or U-shaped) wall structure that extends across the drink-through lid 30. In an embodiment, the valley 80 may be located along all (e.g., see FIGS. 1 and 10) or a portion of a diameter line of the drink-through lid 30. Similarly, in FIGS. 19 and 22, in an embodiment, a valley 90 may be located along all, or a portion (e.g., see FIGS. 19 and 22) of a diameter line of a drink-through lid 39, as defined by sidewalls 92 and 94. In an embodiment, the valley 80 may be oriented along all or a portion of a chord line across the drink-through lid 30. Similarly, in an embodiment, the valley 90 may be oriented along all or a portion of a chord line across drink-through lid 39.

Figure 22:
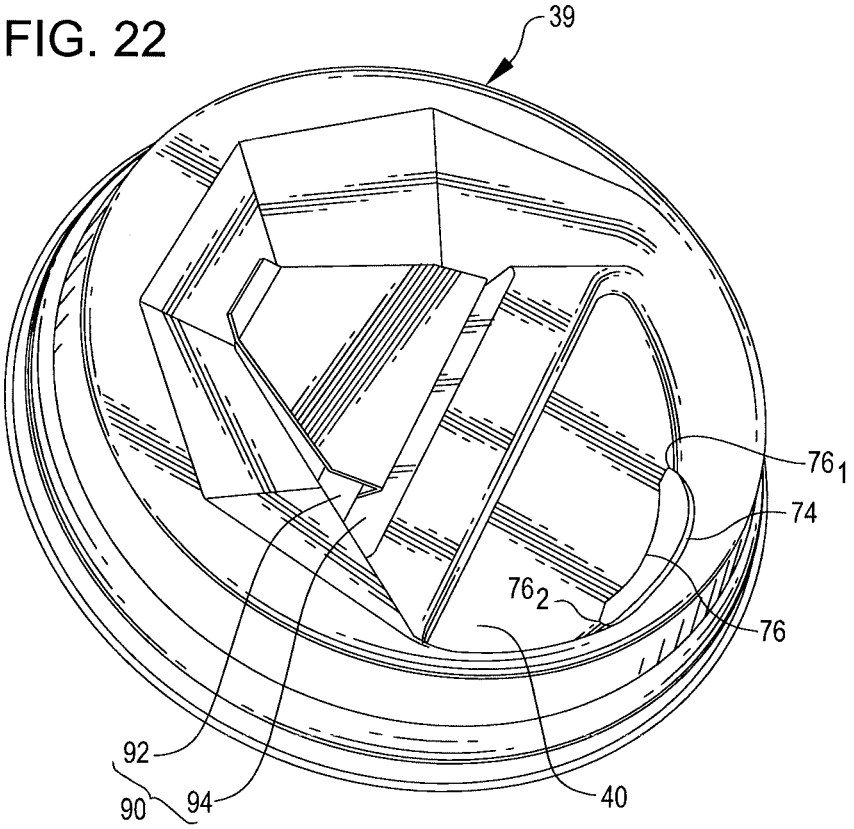
FIG. 22 is a perspective view of an embodiment for a drink-through lid for a cup, having a drink well base into which liquid emerges for consumption, and which also shows a spill resistant tab which extends in part through the lid, and with respect to which the handle portion and the ear portion of the handle are shown in a working location with the tab locked into a working position via interference fit dimensions with the V-shaped groove through which the blade has been inserted, and which blade appears below the drink outlet.

As seen in FIGS. 1, 2, 10 and 11, in an embodiment, a slit 86 of length LS may be formed along a line between sidewalls 82 and 84. Similarly, as seen in FIGS. 19, and 22, in an embodiment, a slit 96 may be formed along a line between sidewalls 92 and 94. A slit 86 may be provided between first end $88_1$ and second end $88_2$, at first edge $82_1$ at wall 82 and a second edge $84_1$ at wall 84. Similarly, as regards the lid 39 shown in FIGS. 19 and 22, a slit 96 may be provided between first end $98_1$ and second end 982, at first edge $92_1$ at wall 92 and a second edge $94_1$ at wall 94.

Attention is directed to FIGS. 3 through 9, where a first embodiment for a spill resistant tab 100 depicted. In an embodiment, a spill resistant tab 100 may be provided having a blade portion 102, a handle portion 104, and a connector portion 106 there between. In an embodiment, each of the blade portion 102 and handle portion 104, may be provided in a generally planar shape. In such an embodiment, connector portion 106 may be joined to blade portion 102 at a first hinge fold 110 having an angle delta ($\Delta$). In such an embodiment, connector portion 106 may be joined to handle portion 104 at a second hinge fold 112 having an angle phi ($\phi$). As seen in FIGS. 1 and 2, in an embodiment, a spill resistant tab 100 may be sized, shaped, and configured for insertion through slit 86.

Attention is further directed to FIGS. 12 through 18, where a second embodiment for a spill resistant tab 200 is depicted. In an embodiment, a spill resistant tab 200 may be provided having a blade portion 202, a handle portion 204, and a connector portion 206 there between. In an embodiment, each of the blade portion 202 and handle portion 204, may be provided in a generally planar shape. In such an embodiment, connector portion 206 may be joined to blade portion 202 at a first hinge fold 210 having an angle delta ($\Delta$). In such an embodiment, connector portion 206 may be joined to handle portion 204 at a second hinge fold 212 having an angle phi ($\phi$). As seen in FIGS. 19, 20, and 21, in an embodiment, a spill resistant tab 200 may be configured for insertion through slit 96.

A spill resistant tab 100 or 200 may be configured for use with a drink-through lid 30 or 39, respectively, having a drink outlet 34 with effective opening width $W_1$, as noted in FIG. 19. In various embodiments, a spill resistant tab 100 or 200 may be provided with a blade portion 102 or 202 respectively width $W_2$ and a length of $L_B$ sufficiently long to situate the blade portion 102 or 202 under a drink outlet 34 when the tab 102 or 202 is secured to a drink-through lid 30 or 39. In an embodiment, blade portion 102 or 202 may have a length $L_B$ of about 1.620 inches. In an embodiment, the blade portion 102 or 202 may have a width $W_2$ of about 1.5 inches.

In various embodiments, a spill resistant tab 100 or 200 may have a blade portion 102 or 202, respectively, which includes a distally located blade edge 120 or 220, respectively. In an embodiment, the distally located blade edge 120 or 220 may be configured as a smooth radiused edge. In an embodiment, the distally located blade edge 120 or 220 may have a radius of curvature along a radius of 1.620 inches.

In various embodiments, spill resistant tabs 100 or 200 may have blade portions 102 or 202 respectively which are substantially planar. As an example, blade portions 102 or 202 may be provided having a thickness of about 0.015 inches. Blade portions 102 or 202 may be provided in thicker dimensions and still provide the spill resistance and prevention benefits described herein. Blade portions 102 and 202 need not be configured in a planar configuration, and may still provide spill resistance and prevention benefits described herein. In an embodiment, a spill resistant tab 200 may have a blade portion 202 that includes substantially planar portions 222 and one or more stiffening ribs 224.

In an embodiment of spill resistant tabs 100 or 200, handle portions 104 or 204, respectively may be provided in a substantially planar configuration. In an embodiment of spill resistant tabs 100 or 200, the handle portions may further include an upwardly extending ear portion, 130 or 230, respectively. In various embodiments, the handle portions 104 or 204 may be joined to ear portions 130 or 230 at an angle sigma (Σ). In an embodiment, the angle sigma may be about 100 degrees or more. In an embodiment, the angle sigma may be about 115 degrees or more.

Figure 23:
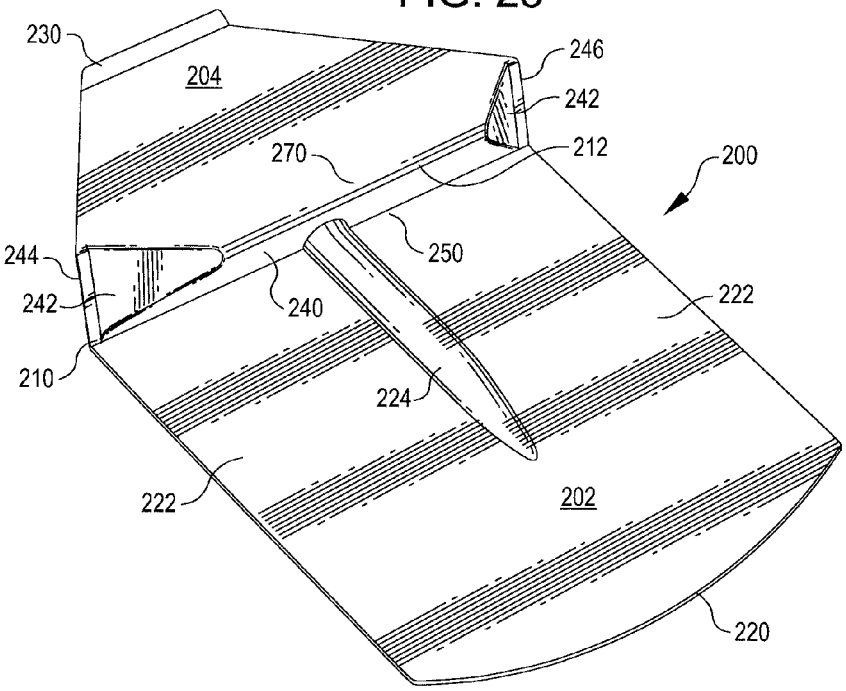
FIG. 23 is a perspective view of the obverse side of a second embodiment for a spill resistant tab for use in a lid for a beverage container, similar to the view shown in FIG. 12 above, and further depicting details of an embodiment for a connector between the blade and the handle, as well as stiffening panels on the sides of the connector, and the use of a stiffening rib on the blade.
Figure 24:
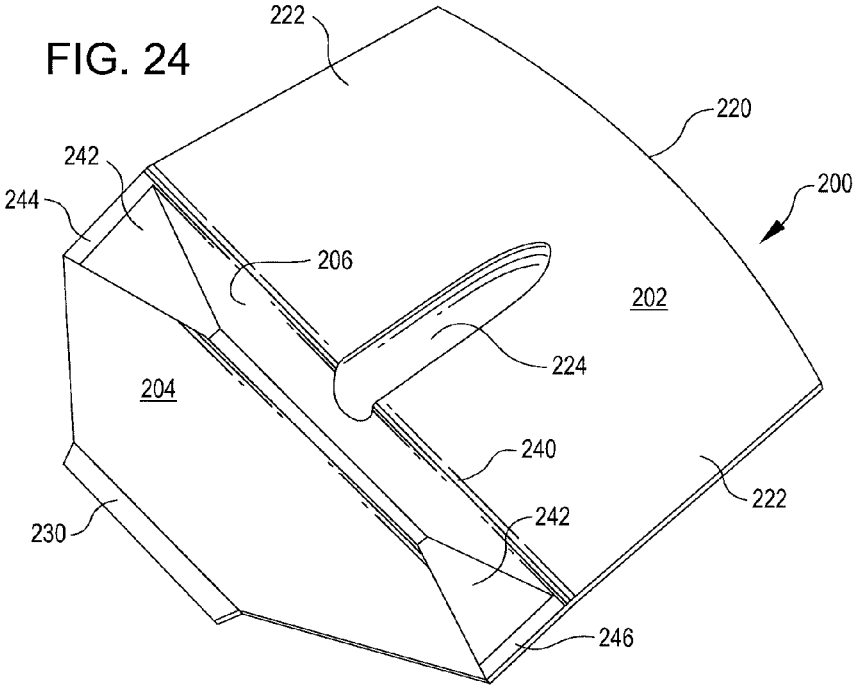
FIG. 24 is a perspective view of the reverse side of a second embodiment for a spill resistant tab for use in a lid for a beverage container, somewhat similar to the view shown in FIG. 18 above, but now provided at an angle which further depicts details of an embodiment for a connector between the blade and the handle, and showing the reverse side of an embodiment for stiffening panels on the sides of the connector, and for an embodiment of a stiffening rib on the blade.
Figure 25:
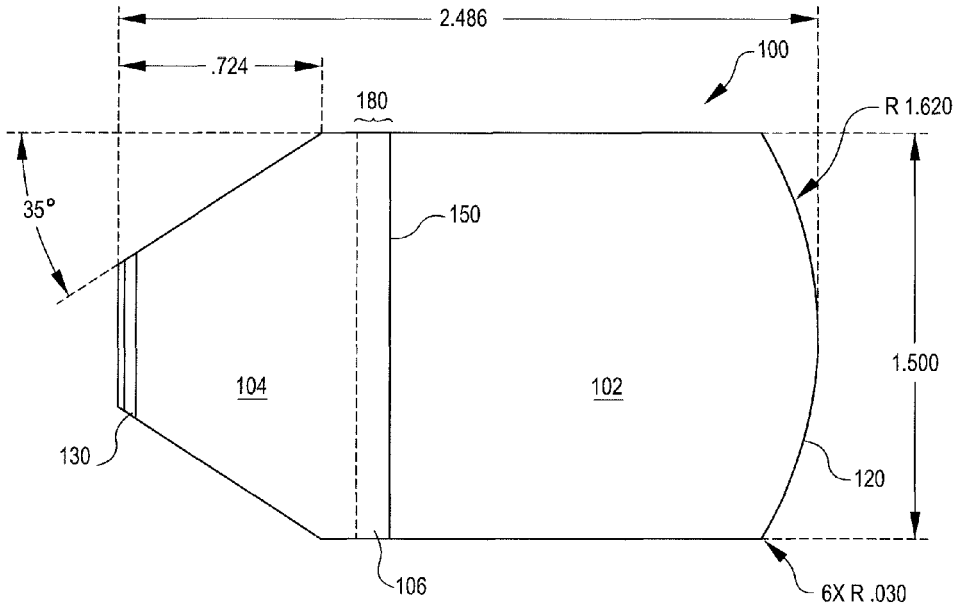
FIG. 25 is a top plan view of a first embodiment for a spill resistant tab, similar to the view shown above at FIG. 8, but now showing additional dimensional details for an embodiment of a spill resistant tab, including a blade width and a radiused blade edge for close conforming engagement with an inner sidewall of a beverage container in which the blade is placed.

In various embodiments, connector portions 106 or 206 may be substantially planar. In spill resistant tab 200, as seen in FIGS. 23 and 24, the connector portion may have a substantially planar central portion 240. In such an embodiment, the connector portion 206 may further include a pair of stiffening panels 242. One of the stiffening panels 242 may be located along each of first 244 and second 246 sides of said connector portion 206.

In various embodiments of spill resistant tabs 100 or 200, connector portions 106 or 206 may be, or have portions which are substantially planar, and the blade portions 102 or 202 may have a substantially planar blade proximal portion 150 or 250 adjacent the connector portions 106 or 206. In such embodiments, the connector portion 106 or 206 may be joined to the proximal portion 150 or 260 of blade portions 102 or 202 at a first hinge fold having an angle delta (Δ). In an embodiment, the angle delta (Δ) of the first hinge fold 110 or 210, respectively, may be in the range of from about fifty five (55) degrees to about seventy five (75) degrees. In an embodiment, the angle delta of the first hinge fold 110 or 210 may be in the range of from about sixty (60) degrees to about seventy (70) degrees. In an embodiment, the angle delta of the first hinge fold 110 or 210 may be about sixty six (66) degrees.

In various embodiments, the connector portion 106 be substantially planar, and the blade portion 102 may have a lower side 160 and a distal blade edge 120, wherein the first hinge fold 110 and the blade portion 102 are sufficiently flexible to allow movement of the distal blade edge 120 of the blade portion 102 by an angle theta (θ) (see FIG. 2), in response to liquid 36 from an interior portion $\mathbf{35}_I$ of a beverage cup or container 32 against the lower side 160 of the blade portion 102.

Figure 26:
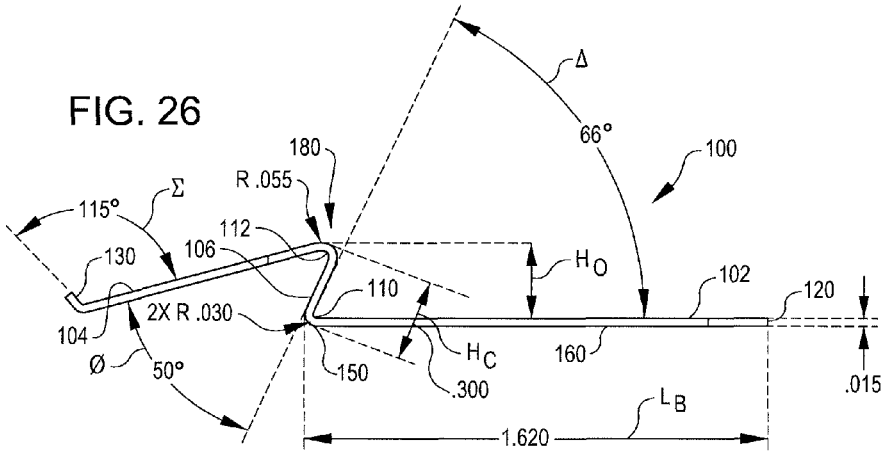
FIG. 26 is a right side view of a first embodiment for a spill resistant tab, similar to that shown at FIG. 7 above, but now showing additional dimensional details for an embodiment of a spill resistant tab, including a blade length, connector length, and an embodiment in which the connector is joined to the handle and the blade in a generally Z-shaped configuration.

In various embodiments, a spill resistant tab 100 or 200 may include a handle portion 104 or 204, respectively, which has a handle proximal portion 170 or 270, respectively, adjacent a connector portion 106 or 206, wherein the handle proximal portion 170 or 270 and the respective connector portion 106 or 206 are joined at a second hinge fold 112 or 212, respectively, having an angle phi (ϕ) (see FIG. 26). In an embodiment, the angle phi (ϕ) of the second hinge fold 112 or 212, respectively, may be in the range of from about forty (40) to about sixty (60) degrees. In an embodiment, the angle phi (ϕ) of the second hinge fold 112 or 212 may be in the range of from about forty five (45) to about fifty five (55) degrees. In an embodiment, the angle phi (ϕ) of the second hinge fold 112 or 212 may be about fifty (50) degrees.

Overall, for improved spill resistance the blade portion 102 or 202 width $W_2$ may be equal to or larger than the effective opening width $W_1$ of a drink outlet 34. In various embodiments, the blade portion 102 or 202 width $W_2$ may be larger than the effective opening width $W_1$ by about 0.25 inches, or more. In various embodiments, the blade portion 102 or 202 width $W_2$ may be larger than the effective opening width $W_1$ by about 0.5 inches, or more. In various embodiments, spill resistant tabs 100 or 200 may include blade portions 102 or 202 that are substantially planar in shape, and which have a distal blade edge 120 or 220, wherein the distal blade edge 120 or 220 is sized and shaped to match an interior wall $\mathbf{32}_W$ of a beverage container 32 in which the spill resistant tab 100 or 200 is utilized. Such a configuration effectively creates a spill barrier between a drink outlet 34 of a lid 30 or 39 and an interior $\mathbf{32}_I$ of a beverage container. In various embodiments, a distal blade edge 120 or 220 of the blade portion 102 or 202 may be radiused to provide a gap G between the distal blade edge 120 or 220 of the tab 100 or 200, respectively, and an interior wall $\mathbf{32}_W$ of a beverage container 32. In an embodiment, the gap G may be about 0.050 inches, or less. In an embodiment, the gap G may be about 0.040 inches, or less. In an embodiment, the gap G may be about 0.040 inches, or less. In an embodiment, the gap G may be about 0.030 inches, or less. In an embodiment, the gap G may be about 0.020 inches.

In an embodiment, as shown in FIG. 26, a spill resistant tab 100 or 200 may have a connector portion height $H_C$. In an embodiment the height $H_C$ may be about 0.30 inches.

In an embodiment, as also indicated in FIG. 26, a spill resistant tab 100 or 200 may be configured so that the blade portion (102 or 202) and the handle portion (104 or 204) are offset at the second hinge fold (112 or 212) by an overall height $H_O$.

In various embodiments, spill resistant tabs may be configured wherein the connector portion (106 or 206) joins the handle portion (104 or 204) and the blade portion (102 or 202) in a generally Z-shaped connection. In various embodiments, spill resistant tabs 100 or 200 may be utilized with drink-through lids 30 or 39 that have a valley shaped portion (80 or 90), wherein the generally Z-shaped connection (180 or 280 respectively) in the tabs 100 or 200 is sized and shaped for interlocking mating engagement with at least some of the valley shaped portion 80 or 90 of the drink-through lid 30 or 39.

Various embodiments may be provided using various types of plastics, such as thermoplastics. In various embodiments, the combination of a lid and beverage cup may be disposable, in that they are intended only for a single use.

For such uses, very inexpensive thermoplastic materials may be suitable for construction of the lids 30 or 39. And, in such uses, a disposable spill resistant tab 100 may be utilized. Other than the exemplary structural techniques just taught above for facilitating manufacture of lid designs 30 and 39 as taught herein, the processes for manufacturing such goods are well known in the art, and thus will not be further explained herein. However, those skilled in the art will recognize that various embodiments may be manufactured using other processes, and consequently, the invention is not limited to any particular method of manufacture.

In the foregoing description, for purposes of explanation, numerous details have been set forth in order to provide a thorough understanding of the disclosed exemplary embodiments for the design of a disposable lid with spill resistant tab for use in combination with a beverage container. However, certain of the described details may not be required in order to provide useful embodiments, or to practice selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more activities may be performed simultaneously, or eliminated in part or in whole while other activities may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, and open ended, and thus should be interpreted to mean "including, but not limited to", unless the context expressly dictates otherwise.

From the foregoing, it can be understood by persons skilled in the art that a novel beverage container lid, and spill resistant tab for use with a beverage container lid, have been described herein. Although only certain specific embodiments of the present invention have been shown and described, there is no intent to limit this invention by these embodiments. Rather, the invention is to be defined by the appended claims and their equivalents when taken in combination with the description.

Importantly, the aspects and embodiments described and claimed herein may be modified from those shown without materially departing from the novel teachings and advantages provided, and may be embodied in other specific forms without departing from the spirit or essential characteristics thereof. More generally, drink-through lid designs with spill resistant tabs, whether or not including a precisely V-shaped groove with slit for accommodation of a spill resistant tab, may be configured using the teaching hereof, and are thus intended to be included with the breadth of appropriate claims as set forth below. Therefore, the embodiments presented herein are to be considered in all respects as illustrative and not restrictive or limiting. As such, this disclosure is intended to cover the structures described herein and not only structural equivalents thereof, but also equivalent structures.

Numerous modifications and variations are possible in light of the above teachings. Therefore, the protection afforded to this invention should be limited only by the claims set forth herein, and the legal equivalents thereof.

SPECIFICATION CLAIM APPENDIX

1. A spill resistant tab for use with a drink-through lid having a drink outlet with effective opening width $W_1$, comprising:

a blade portion, a handle portion, and a connector portion between said blade portion and said handle portion, said blade portion having a width $W_2$ and a length of $L_B$ sufficiently long to situate said blade portion under said drink outlet when secured to said drink-through lid.

2. A spill resistant tab as set forth in claim 1, wherein said length $L_B$ is about 1.620 inches.

3. A spill resistant tab as set forth in claim 1, wherein said blade portion has a width $W_2$ of about 1.5 inches.

4. A spill resistant tab as set forth in claim 1, wherein said blade portion comprises a distally located blade edge.

5. A spill resistant tab as set forth in claim 4, wherein said blade edge comprises a smooth radiused edge.

6. A spill resistant tab as set forth in claim 5, wherein said smooth radiused edge has a radius of curvature along a radius of 1.620 inches.

7. A spill resistant tab as set forth in claim 1, wherein said blade portion is substantially planar.

8. A spill resistant tab as set forth in claim 1, wherein said blade portion comprises substantially planar portions and one or more stiffening ribs.

9. A spill resistant tab as set forth in claim 1, wherein said handle portion of said spill resistant tab is substantially planar.

10. A spill resistant tab as set forth in claim 1, wherein said handle portion of said spill resistant tab comprises a substantially planar portion, and an upwardly extending ear portion.

11. A spill resistant tab as set forth in claim 1, wherein said substantially planar portion of said handle portion and said upwardly extending ear portion are joined at an angle sigma ($\Sigma$).

12. A spill resistant tab as set forth in claim 11, wherein said angle sigma ($\Sigma$) is about one hundred (100) degrees or more.

13. A spill resistant tab as set forth in claim 11, wherein said angle sigma ($\Sigma$) is about one hundred fifteen (115) degrees or more.

14. A spill resistant tab as set forth in claim 1, wherein said connector portion is substantially planar.

15. A spill resistant tab as set forth in claim 1, wherein said connector portion comprises a substantially planar central portion.

16. A spill resistant tab set forth in claim 15, wherein said connector portion further comprises a pair of stiffening panels, one of said stiffening panels located along each of first and second sides of said connector portion.

17. A spill resistant tab as set forth in claim 1, wherein said connector portion is substantially planar, and wherein said blade portion comprises a substantially planar blade proximal portion adjacent said connector portion, and wherein said connector portion and said blade proximal portion are joined at a first hinge fold having an angle delta ($\Delta$).

18. A spill resistant tab as set forth in claim 15, wherein said angle delta ($\Delta$) of said first hinge fold is in the range of from about fifty five (55) to about seventy five (75) degrees.

19. A spill resistant tab as set forth in claim 15, wherein said angle delta ($\Delta$) of said first hinge fold is in the range of from about sixty (60) to about seventy (70) degrees.

20. A spill resistant tab as set forth in claim 15, wherein said angle delta (Δ) of said first hinge fold is about sixty six (66) degrees.

21. A spill resistant tab as set forth in claim 15, wherein said connector portion is substantially planar, and wherein said blade portion comprises a lower side and a distal end, and wherein said first hinge fold and said blade portion are sufficiently flexible to allow movement of said distal end of said blade portion by an angle theta, in response to liquid from an interior portion of a beverage cup against said lower side of said blade portion.

22. A spill resistant tab as set forth in claim 1, wherein said handle portion comprises a handle proximal portion adjacent said connector portion, and wherein said handle proximal portion and said connector portion are joined at a second hinge fold having an angle phi.

23. A spill resistant tab as set forth in claim 19, wherein said angle phi (ϕ) of said second hinge fold is in the range of from about forty (40) to about sixty (60) degrees.

24. A spill resistant tab as set forth in claim 19, wherein said angle phi (ϕ) of said second hinge fold is in the range of from about forty five (45) to about fifty five (55) degrees.

25. A spill resistant tab as set forth in claim 19, wherein said angle phi (ϕ) of said second hinge fold is about fifty (50) degrees.

26. A spill resistant tab as set forth in claim 1, wherein said blade portion width $W_2$ is equal to or larger than said effective opening width $W_1$.

27. A spill resistant tab as set forth in claim 1, wherein said blade portion width $W_2$ is larger than said effective opening width $W_1$ by about 0.25 inches, or more.

28. A spill resistant tab as set forth in claim 1, wherein said blade portion width $W_2$ is larger than said effective opening width $W_1$ by about 0.5 inches, or more.

29. A spill resistant tab as set forth in claim 1, wherein said blade portion is substantially planar in shape, and further comprises a distal edge, and wherein said distal edge is sized and shaped to match an interior wall of a beverage container in which said spill resistant tab is utilized, to substantially create a spill barrier between a drink opening of a lid and an interior of a beverage container.

30. A spill resistant tab as set forth in claim 29, wherein said distal edge of said blade portion radiused to provide a gap G between said distal edge and an interior wall of a beverage container.

31. A spill resistant tab as set forth in claim 30, wherein said gap G is about 0.050 inches, or less.

32. A spill resistant tab as set forth in claim 30, wherein said gap G is about 0.040 inches, or less.

32. A spill resistant tab as set forth in claim 30, wherein said gap G is about 0.040 inches, or less.

33. A spill resistant tab as set forth in claim 30, wherein said gap G is about 0.030 inches, or less.

34. A spill resistant tab as set forth in claim 30, wherein said gap G is about 0.020 inches.

35. A spill resistant tab as set forth in claim 1, wherein said connector portion has a height $H_C$.

36. A spill resistant tab as set forth in claim 35, wherein said height $H_C$ is about 0.30 inches.

37. A spill resistant tab as set forth in claim 1, wherein said blade portion and said handle portion are offset at said second hinge fold by an overall height $H_O$.

38. A spill resistant tab as set forth in claim 1, wherein said connector portion joins said handle portion and said blade portion in a generally Z-shaped connection.

39. A spill resistant tab as set forth in claim 38, wherein the drink through lid includes a valley shaped portion, and wherein said generally Z-shaped connection is sized and shaped for interlocking mating engagement with said valley shaped portion of the drink-through lid.

I claim:

1. A drink-through lid for a beverage cup having an open end, comprising:

a base comprising a rim having a bottom edge, and an interior bead sealing portion, said base sized and shaped to sealingly engage the open end of the beverage cup;

a raised lip portion having an exterior portion extending upwardly from said base, an outer lip portion, and an interior portion sloping downwardly from said outer lip portion to lower end portions;

a drink well base having a floor extending from a peripheral side adjacent said lower end portions, the drink well base located downward from said outer lip portion, said drink well having an underside;

at least one drink outlet, said at least one drink outlet defined by a first edgewall extending upward into said interior portion of said raised lip portion and by an elongated second edgewall of effective opening width $W_1$ extending along an outlet portion of said drink well base, said at least one drink outlet oriented at least in part as if along a first surface extending from said elongated second edgewall substantially at an angle alpha (α) in the range of from about forty-five degrees (45°) to about ninety degrees (90°), so that said at least one drink outlet is substantially vertically oriented;

a downwardly extending valley shaped wall, said valley shaped wall comprising first and second sidewalls extending across at least a portion of said lid, and a slit of length LS between said first and second sidewalls;

a spill resistant tab, said spill resistant tab comprising a blade portion, a handle portion, and a connector portion between said blade portion and said handle portion, said blade portion sized and shaped to fit through said slit, said blade portion secured in a working position below said underside of said drink well adjacent said at least one drink outlet, said blade portion having a width $W_2$ sufficient to resist movement of liquid outward through said at least one drink outlet; and wherein said blade portion is sized, shaped, and positioned to resist splash of liquid from inside the beverage cup toward said at least one drink outlet, while allowing liquid to flow around said blade portion to said at least one drink outlet before escaping to said drink well base.

2. A drink-through lid as set forth in claim 1, wherein said valley shaped wall comprises a V-shaped wall.

3. A drink-through lid as set forth in claim 1, wherein said beverage cup has an interior wall, and wherein said blade portion comprises a distally located blade edge sized and shaped for close fitting engagement near or with said interior wall.

4. A drink through lid as set forth in claim 3, wherein said bladed edge comprises a smooth radiused edge.

5. A drink through lid as set forth in claim 4, wherein said smooth radiused edge has a radius of curvature along a radius of 1.620 inches.

6. A drink-through lid as set forth in claim 1, wherein said at least one drink outlet has an effective opening width $W_1$ of about 1.0 inches.

7. A drink-through lid as set forth in claim 1, or in claim 6, wherein said blade portion has a width $W_2$ of about 1.5 inches.

8. A drink-through lid as set forth in claim 1, wherein said blade portion of said spill resistant tab is substantially planar.

9. A drink-through lid as set forth in claim 1, wherein said blade portion comprises substantially planar portions and one or more stiffening ribs.

10. A drink-through lid as set forth in claim 1, wherein said handle portion of said spill resistant tab is substantially planar.

11. A drink-through lid as set forth in claim 1, wherein said handle portion of said spill resistant tab comprises a substantially planar portion, and an upwardly extending ear portion.

12. A drink-through lid as set forth in claim 1, wherein said connector portion of said spill resistant tab is substantially planar.

13. A drink-through lid as set forth in claim 1, wherein said connector portion of said spill resistant tab comprises a substantially planar central portion.

14. A drink-through lid as set forth in claim 13, wherein said connector portion further comprises a pair of stiffening panels, one of said stiffening panels located along each of first and second sides of said connector portion.

15. A drink-through lid as set forth in claim 1, wherein said blade portion comprises a substantially planar blade proximal portion adjacent said connector portion, and wherein said blade proximal portion, and said connector portion are joined at a first hinge fold having an angle delta.

16. The drink-through lid as set forth in claim 15, wherein said angle delta of said first hinge fold is in a range of from about 55 to about 75 degrees.

17. The drink through lid as set forth in claim 15, wherein said angle delta of said first hinge fold is in a range of from about 60 to about 70 degrees.

18. A drink-through lid as set forth in claim 1, wherein said handle portion comprises a substantially planar handle proximal portion adjacent said connector portion, and wherein said handle proximal portion and said connector portion are joined at a second hinge fold having an angle phi.

19. The drink-through lid as set forth in claim 18, wherein said angle phi of said second hinge fold is in a range of from about 40 to about 60 degrees.

20. The drink through lid as set forth in claim 19, wherein said angle phi of said second hinge fold is in a range of from about 45 to about 55 degrees.

21. The drink-through lid as set forth in claim 1, wherein said blade portion width $W_2$ is equal to or larger than said effective opening width $W_1$.

22. The drink-through lid as set forth in claim 1, wherein said blade portion width $W_2$ is larger than said effective opening width $W_1$ by about 0.25 inches, or more.

23. The drink-through lid as set forth in claim 1, wherein said blade portion width $W_2$ is larger than said effective opening width $W_1$ by about 0.5 inches, or more.

24. The drink-through lid as set forth in claim 1, wherein said connector portion of said spill resistant tab is sized and shaped for secure mating engagement with at least a portion of said valley shaped wall, wherein said spill resistant tab is secured to allow drinking from said beverage cup while providing resistance to liquid flow through said at least one drink outlet.

25. The drink-through lid as set forth in claim 1, wherein said spill resistant tab has a Z-shaped profile, as examined in vertical cross-section, between said blade portion and said handle portion.

26. The drink-through lid as set forth in claim 25, wherein said connector portion of said spill resistant tab is sized and shaped for close fitting engagement with said downwardly extending valley shaped wall, wherein said spill resistant tab is secured to allow drinking from a beverage cup while providing resistance to liquid flow through a drink outlet in a drink-through lid.

* * * * *